US011162223B2

(12) United States Patent
Paulson et al.

(10) Patent No.: US 11,162,223 B2
(45) Date of Patent: Nov. 2, 2021

(54) FIBROUS STRUCTURES COMPRISING ACIDIC CELLULOSIC FIBERS AND METHODS OF MANUFACTURING THE SAME

(71) Applicant: Kimberly-Clark Worldwide, Inc., Neenah, WI (US)

(72) Inventors: David John Paulson, Appleton, WI (US); Richard Louis Underhill, Neenah, WI (US); Mike Thomas Goulet, Neenah, WI (US); Kenneth John Zwick, Neenah, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 113 days.

(21) Appl. No.: 16/498,087

(22) PCT Filed: Mar. 27, 2018

(86) PCT No.: PCT/US2018/024579

§ 371 (c)(1),
(2) Date: Sep. 26, 2019

(87) PCT Pub. No.: WO2018/183335

PCT Pub. Date: Oct. 4, 2018

(65) Prior Publication Data

US 2020/0032456 A1 Jan. 30, 2020

Related U.S. Application Data

(60) Provisional application No. 62/478,927, filed on Mar. 30, 2017.

(51) Int. Cl.

| | |
|---|---|
| ***D21H 17/25*** | (2006.01) |
| ***D21H 17/28*** | (2006.01) |
| ***D21H 17/37*** | (2006.01) |
| ***D21H 17/55*** | (2006.01) |
| ***D21H 17/56*** | (2006.01) |
| ***D21H 17/65*** | (2006.01) |
| ***D21H 21/20*** | (2006.01) |
| ***D21H 27/00*** | (2006.01) |

(52) U.S. Cl.
CPC ..... *D21H 17/25* (2013.01); *D21H 17/28* (2013.01); *D21H 17/375* (2013.01); *D21H 17/55* (2013.01); *D21H 17/56* (2013.01); *D21H 17/65* (2013.01); *D21H 21/20* (2013.01); *D21H 27/002* (2013.01)

(58) Field of Classification Search
USPC ..... 162/167
See application file for complete search history.

(56) References Cited

U.S. PATENT DOCUMENTS

| | | | | |
|---|---|---|---|---|
| 4,252,761 A | | 2/1981 | Schoggen et al. | |
| 4,308,092 A | * | 12/1981 | Latimer | D21H 17/45 162/111 |
| 4,406,737 A | * | 9/1983 | Latimer | D21H 17/45 162/111 |
| 6,149,769 A | * | 11/2000 | Mohammadi | D21F 11/14 162/109 |

FOREIGN PATENT DOCUMENTS

| | | | |
|---|---|---|---|
| CN | 103132385 | A | 6/2013 |
| WO | 08138386 | A1 | 11/2008 |
| WO | 16190801 | A1 | 12/2016 |

* cited by examiner

*Primary Examiner* — Mark Halpern
(74) *Attorney, Agent, or Firm* — Kimberly-Clark Worldwide, Inc.

(57) ABSTRACT

The invention relates to fibrous structures having desirable physical properties, such as good tensile strength, low stiffness and high bulk, manufactured using a fiber furnish comprising cellulosic fibers having a pH of 5.0 or less and at least one strength resin. Not only do structures prepared with acidic fibers have desirable physical properties, they may also be manufactured in an energy efficient manner. To achieve the greatest energy savings it is generally desirable that acidic fibers not be subjected to mechanical treatment, such as by refining, prior to forming the fiber into a fibrous structure. Further, it may be desirable to subject the remainder of the fiber furnish to a minimal degree of mechanical treatment, such as by refining, so as to produce a furnish having a freeness greater than about 550 mL.

14 Claims, 1 Drawing Sheet

FIBROUS STRUCTURES COMPRISING ACIDIC CELLULOSIC FIBERS AND METHODS OF MANUFACTURING THE SAME

This application is a 371 of PCT/US2018/024579 filed on 27 Mar. 2018

BACKGROUND

In the manufacture of fibrous structures such as paper towels, napkins, tissue, wipes, and the like, there are generally two different methods of making the base sheets. These methods are commonly referred to as wet-pressing and through-air drying. While the two methods differ in the manner in which water is removed from the wet web after its initial formation, both methods require relatively large amounts of energy to dewater and dry the nescient tissue web.

In the through-air drying method, the newly-formed web is transferred to a relatively porous fabric and non-compressively dried by passing hot air through the web. The resulting web can then be transferred to a Yankee dryer for creping. Because the web is substantially dry when transferred to the Yankee, the density of the web is not significantly increased by the transfer. Also, the density of a through-air dried sheet is relatively low by nature because the web is dried while supported on the through-air drying fabric. The disadvantages of the through-air drying method, though, are the operational energy cost and the capital costs associated with the through-air dryers.

In the through-air drying process, water is removed by at least two processes: vacuum dewatering and then through-air drying. Vacuum dewatering is initially used to take the sheet from the post-forming consistency of around 10 percent to roughly 20-28 percent, depending on the particular furnish, speed and local energy costs. It is well known that the cost of water removal is relatively low at low consistencies, but increases exponentially as more water is removed. Hence, vacuum dewatering is generally used until the cost of additional water removal becomes higher than that of the succeeding through-air drying stage.

In the through-air drying stage, the energy cost again varies depending on the process and furnish specifics, but in all cases requires a minimum of 1000 BTU/pound of water removed because this is the latent heat of vaporization of water. In practice, generally about 1500 BTU are required per pound of water removed, with the additional BTU's related to the sensible heat needed to bring the water to the boiling point and energy losses in the system. Despite the relatively high energy input required for through-air drying, however, this process has become the process of choice for soft, bulky tissue because of the resulting product quality.

Thus, what is lacking and needed in the art is a method of making consumer-preferred low-density fibrous structures with reduced energy input.

SUMMARY

It has now been discovered that acidic cellulosic fibers may be used in the manufacture of fibrous structures, such as tissue webs, and that the resulting fibrous structures may have desirable physical properties. It has also been discovered that the inventive fibrous structures may be manufactured in an energy efficient manner. Without wishing to be bound by any particularly theory, it has been hypothesized that acidic cellulosic fibers may also have a lower water retention value (WRV), such as about 1.10 g/g or less, which may make fibrous structures formed therefrom easier to dewater and dry.

Accordingly, in one embodiment the invention provides an acidic cellulosic fiber having a relatively low water retention value (WRV), such as a WRV of about 1.10 g/g or less, that may be used to manufacture fibrous structures with improved energy efficiency and productivity while maintaining or improving important physical attributes such as strength, stiffness and sheet bulk. Thus, in certain embodiments the present invention provides a process for economically producing strong, bulky and low stiffness fibrous structures with improved energy and/or capital efficiency.

In other embodiments the present invention provides a method of manufacturing a fibrous structure comprising the steps of providing a fibrous furnish comprising cellulosic fibers having a pH less than about 5.0 and from about 1.0 to about 20 kilograms (kg) strength resin per metric ton (MT) of dry fibrous furnish; depositing the fibrous furnishes on a forming fabric to form a wet fibrous web; partially dewatering the wet fibrous web; and drying the fibrous web to a consistency greater than about 95 percent.

In yet other embodiments the present invention provides a method of manufacturing a fibrous structure comprising the steps of dispersing cellulosic fibers in water to form a first aqueous fiber furnish; mechanically treating the first aqueous fiber furnish to yield a furnish having a freeness greater than about 550 mL; dispersing cellulosic fibers having a pH less than about 5.0 in water to form a second aqueous fiber furnish; adding at least about 2.0 kg/MT of strength resin to the first or the second fiber furnish; depositing the first and the second fiber furnishes on a forming fabric to form a wet fibrous web; partially dewatering the wet fibrous web; and drying the fibrous web to a consistency greater than about 95 percent.

In still other embodiments the present invention provides a method of manufacturing a through-air dried tissue product comprising the steps of forming an aqueous fiber furnish comprising long cellulosic fibers and short cellulosic fibers, the short cellulosic fibers having a pH less than about 5.0, the aqueous fiber furnish having a water retention value less than about 1.20 g/g; adding a strength resin selected from the group consisting of polyamide-polyamine epichlorohydrin resins, polyacrylamide resins, carboxymethyl celluloses, starch, starch derivatives, and combinations thereof, to the aqueous fiber furnish; depositing the aqueous fiber furnish on a forming fabric to form a wet fibrous web; partially dewatering the wet fibrous web to a pre-through air dyer consistency greater than about 30 percent; through-air drying the fibrous web to a consistency greater than about 95 percent; and converting the dried fibrous web to a tissue product having a basis weight greater than about 10 grams per square meter (gsm), geometric mean tensile strength (GMT) greater than about 500 g/3" and a sheet bulk greater than about 5.0 cubic centimeters per gram (cc/g).

In yet other embodiments the present invention provides a method of manufacturing a fibrous structure comprising the steps of dispersing long cellulosic fibers in water to form a first aqueous fiber furnish, refining the first aqueous fiber furnish to yield a refined first aqueous fiber furnish having a freeness greater than about 550 mL, dispersing short cellulosic fibers having a pH of about 5.0 or less and a water retention value of about 1.10 g/g or less in water to form a second aqueous fiber furnish; adding a strength resin selected from the group consisting of polyamide-polyamine epichlorohydrin resins, polyacrylamide resins, carboxymethyl celluloses, starch, starch derivatives, and combinations thereof, to the first or second aqueous fiber furnish; depositing the first and the second fiber furnishes on a forming fabric to form a wet fibrous web; partially dewatering the wet fibrous web; and drying the fibrous web to a consistency greater than about 95 percent. In a particularly preferred embodiment the second aqueous fiber furnish is not refined.

In other embodiments the present disclosure provides a method of forming a multi-layered tissue web comprising the steps of dispersing a first fiber in water to form a first aqueous fiber furnish, refining the first aqueous fiber furnish to a freeness greater than about 550 mL, dispersing a second fiber having a pH of about 5.0 or less and a WRV of about 1.10 g/g or less in water to form a second aqueous fiber furnish, depositing the first aqueous fiber furnish onto a forming fabric, depositing the second aqueous fiber furnish on top of the first aqueous fiber furnish to form a wet tissue web, dewatering the wet tissue web to a consistency of from about 20 to about 30 percent, and drying the wet tissue web to a consistency of greater than about 90 percent.

DEFINITIONS

Figure 1:
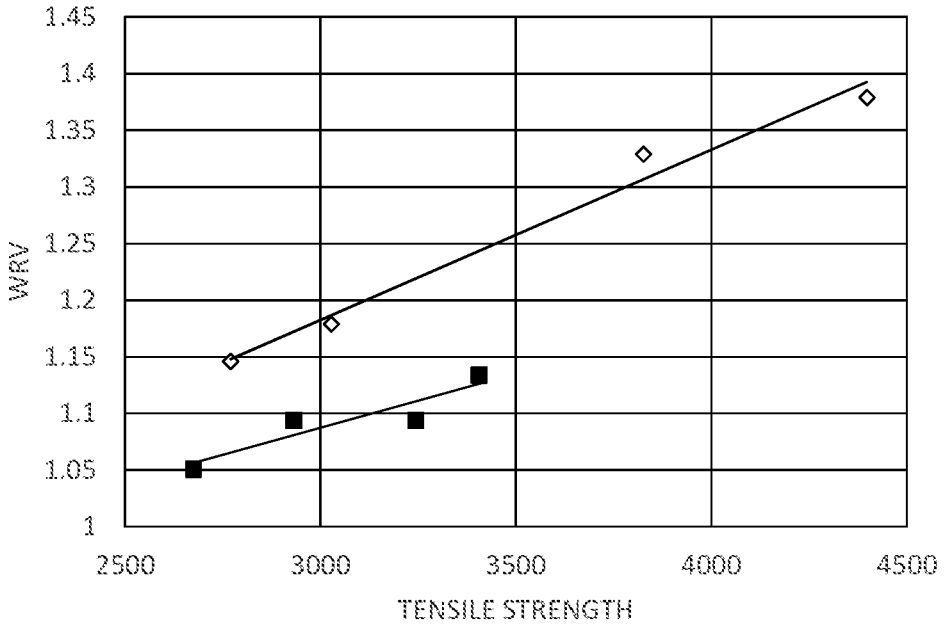
FIG. 1 is a graph of handsheet tensile strength (having units of g/1") versus furnish water retention value (WRV, having units of g/g) for control handsheets (◇) and inventive handsheets (■)
Figure 2:
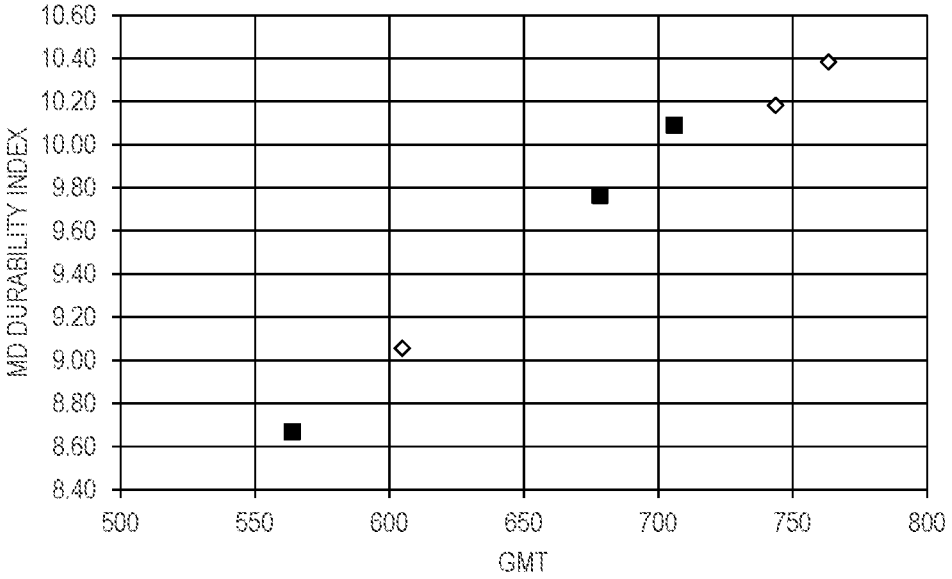
FIG. 2 is a graph of geometric mean tensile strength (GMT having units of g/3") versus machine direction durability index for control tissue products (■) and inventive tissue products (◇).

As used herein, the term "Acidic Cellulosic Fiber" and "Low pH Cellulosic Fiber" means a cellulosic fiber having a pH of about 5.0 or less and more preferably less than about 4.7 and still more preferably less than about 4.5, such as from about 3.0 to about 5.0. The pH of the cellulosic fiber is measured as described in the Test Methods section below.

As used herein, the term "Average Fiber Length" means the length weighted average fiber length (LWAFL) of fibers determined utilizing OpTest Fiber Quality Analyzer, model FQA-360 (OpTest Equipment, Inc., Hawkesbury, ON). According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 mL portions from the dilute solution when tested using the standard Kajaani fiber analysis test procedure. The weighted average fiber length may be expressed by the following equation:

$$\sum_{x_i=0}^{k}(x_i \times n_i)/n$$

where k=maximum fiber length
$x_i$=fiber length
$n_i$=number of fibers having length $x_i$
n=total number of fibers measured.

As used herein the term "Fiber" refers to an elongate particulate having an apparent length greatly exceeding its apparent width, i.e. a length to diameter ratio of at least about 10. More specifically, as used herein, fiber refers to papermaking fibers. The present invention contemplates the use of a variety of papermaking fibers, such as, for example, natural fibers or synthetic fibers, or any other suitable fibers, and any combination thereof. Papermaking fibers useful in the present invention include cellulosic fibers and more particularly wood pulp fibers.

As used herein the term "Cellulosic Fiber" means a fiber composed of or derived from cellulose.

As used herein, the term "Long Cellulosic Fibers" means a cellulosic fiber having an average fiber length greater than 1.2 mm and more preferably greater than about 1.5 mm and still more preferably greater than about 2.0 mm.

As used herein the term "Short Cellulosic Fibers" means a cellulosic fiber having an average length less than 1.2 mm, such as from about 0.4 to about 1.2 mm, such as from about 0.5 to about 0.75 mm, and more preferably from about 0.6 to about 0.7 mm. One example of short cellulosic fibers are hardwood pulp fibers, which may be derived from hardwoods selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore and Beech. In other embodiments short cellulosic fibers may be derived from non-wood plants such as Bagasse, Flax, Hemp, and Kenaf.

As used herein the term "Refined Fibers" refers to any fiber that has been subject to mechanical treatment. A common refining method is to treat fibers in the presence of water with a plate having metallic bars. Commonly refining plates are grooved so that the bars that treat fibers and the grooves between bars allow fiber transportation through the refining machine.

As used herein the term "Aqueous Fiber Furnish" refers to a mixture comprising fibers and water useful in the manufacture of fibrous structures.

As used herein the term "Freeness" refers to the Canadian Standard Freeness (CSF) determined in accordance with TAPPI Standard T 227 OM-94 and is reported in units of milliliters (mL).

As used herein the term "Fibrous Structure" generally refers to a structure, such as a sheet, that comprises a plurality of fibers. In one example, a fibrous structure according to the present invention means an orderly arrangement of fibers within a structure in order to perform a function. Non-limiting examples of fibrous structures of the present invention include paper, fabrics (including woven, knitted, and non-woven), and absorbent pads (for example for diapers or feminine hygiene products).

Non-limiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fiber slurry is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a tissue product.

As used herein, the term "Tissue Product" refers to products made from tissue webs and includes, bath tissues, facial tissues, paper towels, industrial wipers, foodservice wipers, napkins, medical pads, and other similar products. Tissue products may comprise one, two, three or more plies.

As used herein, the terms "Tissue Web" and "tissue sheet" refer to a fibrous sheet material suitable for forming a tissue product.

As used herein, the term "Layer" refers to a plurality of strata of fibers, chemical treatments, or the like, within a ply.

As used herein, the terms "Layered Tissue Web," "Multi-Layered Tissue Web," and "Multi-Layered Web," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein the term "Ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "Basis Weight" generally refers to the bone dry weight per unit area of a tissue and is generally expressed as grams per square meter (gsm). Basis weight is measured using TAPPI test method T-220.

As used herein, the term "Geometric Mean Tensile" (GMT) refers to the square root of the product of the machine direction tensile and the cross-machine direction tensile of the web, which are determined as described in the Test Method section. The GMT of tissue products prepared according to the present invention may vary depending on a variety of factors and the desired end use of the products, however, in certain embodiments the GMT may be greater than about 500 g/3" and more preferably greater than about 700 g/3" and still more preferably greater than about 800 g/3", such as from about 500 to about 3,500 g/3" and more preferably from about 700 to about 2,500 g/3".

As used herein the term "Machine Direction Durability" generally refers to the ability of the web to resist crack propagation initiated by defects in the web and is calculated from MD Tensile Index (calculated by dividing the MD Tensile Strength by the basis weight) and MD stretch (output of the MTS TestWorks™ in the course of determining the tensile strength as described in the Test Methods section) according to the formula:

$$\text{Machine Direction Durability}=0.6(\text{MD Tensile Index}^{0.74}+\text{MD Stretch}^{0.58})$$

The MD Durability of tissue products prepared according to the present invention may vary depending on a variety of factors and the desired end use of the products, however, in certain embodiments the MD Durability may be greater than about 8.0 and more preferably greater than about 9.0 and still more preferably greater than about 10.0, such as from about 8.0 to about 14.0 and more preferably from about 9.0 to about 12.0.

As used herein, the term "Caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "Sheet Bulk" refers to the quotient of the caliper (μ) divided by the bone dry basis weight (gsm). The resulting sheet bulk is expressed in cubic centimeters per gram (cc/g). The Sheet Bulk of tissue products prepared according to the present invention may vary depending on a variety of factors and the desired end use of the products, however, in certain embodiments the Sheet Bulk may be greater than about 5.0 cc/g and more preferably greater than about 8.0 cc/g and still more preferably greater than about 10.0 cc/g, such as from about 5.0 to about 20.0 cc/g and more preferably from about 8.0 to about 16.0 cc/g.

As used herein, the term "Slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams per 3 inch sample width or g/3".

As used herein, the term "Geometric Mean Slope" (GM Slope) generally refers to the square root of the product of machine direction slope and cross-machine direction slope. GM Slope generally is expressed in units of kg or grams. The GM Slope of tissue products prepared according to the present invention may vary depending on a variety of factors and the desired end use of the products, however, in certain embodiments the GM Slope may be less than about 12.0 kg and more preferably less than about 10.0 kg and still more preferably less than about 8.0 kg, such as from about 3.0 to about 12.0 kg and more preferably from about 4.0 to about 8.0 kg.

As used herein, the term "Stiffness Index" refers to the quotient of the geometric mean slope (having units of kg) divided by the geometric mean tensile strength (having units of g/3") multiplied by 1,000. The Stiffness of tissue products prepared according to the present invention may vary depending on a variety of factors and the desired end use of the products, however, in certain embodiments the Stiffness Index may be less than about 12.0 and more preferably less than about 10.0 and still more preferably less than about 8.0, such as from about 3.0 to about 12.0 and more preferably from about 5.0 to about 8.0.

The "Water Retention Value" (WRV) is the amount of water naturally retained by fibers, expressed as grams of water per gram of fiber (g/g). The Water Retention Value is described in U.S. Pat. No. 6,096,169, which is hereby incorporated by reference for that purpose. Preferably the WRV for low pH cellulosic fibers useful in the present invention should be low in order to more easily dewater the fibers with less energy. Preparing cellulosic fibers at a low pH, such as a pH of 5.0 or less, may reduce the WRV by about 10 percent, such as from about 10 to about 30 percent, compared to similar cellulosic fibers a pH greater than 5.0. More specifically, the WRV of the instant low pH cellulosic fibers may be about 1.10 g/g or less, more preferably less than about 1.05 g/g and still more preferably less than about 1.0 g/g, such as from about 0.90 to about 1.10 g/g.

The WRV for a papermaking furnish consisting of more than one type of fiber is the weighted average of the WRV for the individual fiber type components. By way of example, if the furnish consists of 50 percent fiber component "A" having a WRV of 1.33 g/g and 50 percent fiber component "B" having a WRV of 1.41 g/g, the furnish WRV is 0.5 (1.33)+0.5 (1.41)=1.37 g/g. Furnishes useful in forming inventive fibrous structure according to the present invention generally have a WRV of about 1.20 g/g or less, such as from about 0.90 to about 1.20 and more preferably from about 1.0 to about 1.15 and still more preferably from about 1.0 to about 1.075.

As used herein the term "Substantially Free" refers to a layer of a tissue that has not been formed with the addition of treated fiber. Nonetheless, a layer that is substantially free of treated fiber may include de minimus amounts of treated fiber that arise from the inclusion of treated fibers in adjacent layers and do not substantially affect the softness or other physical characteristics of the tissue web.

In the interests of brevity and conciseness, any ranges of values set forth in this specification contemplate all values within the range and are to be construed as written description support for claims reciting any sub-ranges having endpoints which are whole number or otherwise of like numerical values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Similarly, a disclosure in this specification of a range from 0.1 to 0.5 shall be considered to support claims to any of the following ranges: 0.1-0.5; 0.1-0.4; 0.1-0.3; 0.1-0.2; 0.2-0.5; 0.2-0.4; 0.2-0.3; 0.3-0.5; 0.3-0.4; and 0.4-0.5. In addition, any values prefaced by the word "about" are to be construed as written description support for the value itself. By way of example, a range of "from about 1 to about 5" is to be interpreted as also disclosing and providing support for a range of "from 1 to 5," "from 1 to about 5," and "from about 1 to 5."

DETAILED DESCRIPTION

It has now been surprisingly discovered that fibrous structures having desirable physical properties, such as good tensile strength, low stiffness and high bulk, may be manufactured using a fiber furnish comprising cellulosic fibers having a pH of 5.0 or less and at least one strength resin. Further, the foregoing fibrous structures may be manufactured in an energy efficient manner. To preserve the energy benefit obtained by using acidic cellulosic fibers, also referred to herein as low pH fibers, the present inventors have discovered that it may be desirable not to subject the low pH cellulosic fiber to mechanical treatment, such as by refining, prior to forming the fiber into a fibrous structure. Further, it may be desirable to subject the remainder of the fiber furnish to a minimal degree of mechanical treatment, such as by refining, so as to produce a furnish having a freeness greater than about 550 mL.

Rather than mechanically treating the fibers, it may be desirable to add a strength resin to the furnish during manufacture of the fibrous structure to develop strength properties of the resulting fibrous structure. For example, the inventive fibrous structures are typically manufactured by adding from about 2.0 to about 20 kg of strength resin per metric ton of furnish (on a dry furnish basis), resulting in a fibrous structure having a geometric mean tensile greater than about 500 g/3" and more preferably greater than about 600 g/3" and still more preferably greater than about 700 g/3". Developing strength with the addition of strength resins rather than through mechanical treatment of the fiber furnish may preserve the relatively low water retention value (WRV) of the fiber furnish and reduce the energy required to dewater and dry the fibrous structure.

Without wishing to be bound by any particularly theory, it has been hypothesized that acidic cellulosic fibers useful in the present invention have a lower water retention value (WRV), such as about 1.10 g/g or less, which makes the fibrous structures formed therefrom easier to dewater and dry. Thus, in certain embodiments the present invention provides a process for economically producing strong, bulky and low stiffness fibrous structures with improved energy and/or capital efficiency. In this manner, the WRV of the total furnish may be 1.20 g/g or less, such as from about 1.0 to about 1.20 g/g and more preferably from about 1.0 to about 1.15 g/g and still more preferably from about 1.0 to about 1.075 g/g, to increase the energy efficiency of the manufacturing process, and the strength resin may ensure that the resulting fibrous structures possess the desired strength properties, such as geometric mean tensile strength.

Accordingly, in certain embodiments, the present disclosure relates to fibrous structures formed from an aqueous fiber furnish comprising low pH fiber and more particularly cellulosic fibers having a pH of 5.0 or less. In one example, a fibrous structure of the present invention comprises from about 10 to about 100 percent, such as from about 20 to about 100 percent and more preferably from about 30 to about 100 percent, by weight, short cellulosic fibers having a pH of 5.0 or less. In one particularly preferred embodiment the short cellulosic fibers having a pH of 5.0 or less are hardwood kraft pulp fibers having a pH from about 3.0 to 5.0. In another example, a fibrous structure of the present invention comprises short cellulosic fibers having a pH of 5.0 or less and WRV of about 1.10 g/g or less, such as, for example hardwood kraft pulp fibers having a pH from about 3.0 to 5.0 and a WRV from about 0.90 to about 1.10 g/g.

In particularly preferred embodiments at least a portion of the aqueous fiber furnish used to form the fibrous structures of the present invention are short cellulosic fibers having a relatively low pH, such as a pH of 5.0 or less, such as from about 3.0 to about 5.0 and more preferably from about 4.0 to about 5.0. In addition to having a relatively low pH, the short cellulosic fibers may also have a relatively low WRV, such as about 1.10 g/g or less, such as from about from about 0.90 to about 1.10 g/g more preferably from about 0.90 to about 1.05 g/g.

In certain embodiments, in addition to having a low WRV, the low pH fibers increased hemicellulose content relative to comparable fibers having a pH greater than about 6.0. The hemicellulose content may be about 10 percent greater, and more preferably at least about 15 percent and still more preferably at least about 20 percent greater. For example, low pH fibers may be hardwood fibers having a hemicellulose content greater than about 8 percent and more preferably greater than about 8.5 percent, such as from about 8 to about 10 percent.

In particularly preferred embodiments the low pH fibers are short cellulosic fibers derived from either wood or non-woods. More preferably the low pH fibers have an average fiber length less than 1.2 mm, such as from about 0.4 to about 1.2 mm, such as from about 0.5 to about 0.75 mm and more preferably from about 0.6 to about 0.7 mm.

In one embodiment the low pH fibers are cellulosic fibers derived from wood and more preferably hardwoods such as, but not limited to, eucalyptus, maple, birch, aspen, and the like. In a particularly preferred embodiment the low pH fibers are eucalyptus hardwood kraft pulps ("EHWK") having a pH of 5.0 or less, such as from about 3.0 to 5.0. In a particularly preferred embodiment the low pH fibers are not refined and have a freeness greater than about 550 mL, such as from about 550 to about 750 mL and more preferably from about 575 to about 700 mL.

In other embodiments the short fiber fraction of the aqueous fiber furnish may comprise short cellulosic fibers derived from different genus or from different species within a genus. For example, a fibrous structure of the present invention may be manufactured with short pulp fibers derived from two or more different hardwood genus, such as eucalyptus pulp fibers and or acacia pulp fibers, having a pH of 5.0 or less. Further, a fibrous structure of the present invention may be manufactured with short cellulosic fibers derived from two or more different species of the same genus, such as *Eucalyptus grandis* pulp fibers and *Eucalyptus nitens* pulp fibers, having a pH of 5.0 or less.

In another example, a fibrous structure of the present invention may be formed from two or more different short cellulosic fibers having different pH and WRV, such as eucalyptus pulp fibers, having at least two different pH and WRV. For example, one of the short fibers may exhibit a higher pH and WRV than the other short fiber furnish within the fibrous structure.

In addition to low pH fibers, the fiber furnish useful in manufacturing fibrous structures according to the present invention may comprise long cellulosic fibers and more preferably long cellulosic fibers having a fiber length greater than 1.2 mm. The long fiber fraction of the furnish may comprise long cellulosic fibers formed by a variety of pulping processes, such as kraft pulp, sulfite pulp, thermomechanical pulp, and the like. One example of suitable long cellulosic pulp fibers includes softwood fibers, such as, but not limited to, kraft pulp fibers derived from northern softwood, southern softwood, redwood, red cedar, hemlock, pine (e.g., southern pines), spruce (e.g., black spruce), combinations thereof, and the like. Regardless of the origin of the fiber, the long fiber fraction preferably has an average fiber length greater than 1.2 mm and more preferably greater than about 1.5 mm and still more preferably greater than about 2.0 mm, such as from about 1.2 to about 3.0 mm and more preferably from about 1.7 to about 2.5 mm.

In still other embodiments the fiber furnish may comprise, if desired, secondary fibers obtained from recycled materials, such as fiber pulp from sources such as, for example, newsprint, reclaimed paperboard, and office waste.

While the composition of the fiber furnish may vary, in a particularly preferred embodiment the fiber furnish comprises low pH fibers and has a WRV of about 1.10 or less, such as from about 0.90 to about 1.10 g/g and more preferably from about 1.00 to about 1.05 g/g. In a particularly preferred embodiment fibrous structure of the present invention are formed from a fiber furnish having a WRV of about 1.40 g/g or less, such as from about 0.90 to about 1.40 g/g, and comprising from about 20 to about 100 percent, by weight, short cellulosic fibers and from about 0 to about 80 percent, long cellulosic fibers, wherein at the short cellulosic fibers have a pH of 5.0 or less.

In those embodiments where the fibrous structures are formed from a fiber furnish comprising low pH short cellulosic fibers and long cellulosic fibers, it may be preferable to subject the long fiber fraction to mechanical forces, such as by beating or refining, in the presence of water. Refining and beating methods are well known in the art and typically involve subjecting a dilute fiber slurry, such as a fiber slurry having a consistency from about 1 to about 10 percent solids, to mechanical forces applied by a pair of opposed plates. Refining of fibers in this manner generally results in cutting and shortening of fibers, the creation of fines, external fibrillation, swelling, alteration of fiber shape by curling, creating nodes, or kinks and the redistribution of hemicelluloses from the interior of the fiber to the exterior. As a result, after refining the fibers are generally collapsed (flattened) and made more flexible, and their bonding surface area is increased.

In one particularly preferred embodiment the refined fiber comprises refined softwood fibers and more preferably northern softwood kraft (NSWK) fibers that have been refined using a double disc refiner having bar width of segments from about 2.4 about 3.5 mm, a refining intensity (measured as specific edge load "SEL") from about 0.5 to about 1.5 J/m and a refining consistency of about 4.0 to about 5.5 percent. The refined NSWK preferably has a freeness greater than about 500 mL and more preferably greater than about 550 mL, such as from about 500 to about 650 mL.

Regardless of whether the fiber furnish comprises two or more different short cellulosic fibers or a mixture of short and long cellulosic fibers, it is generally preferred that the fiber furnish used to form the instant fibrous structures comprises at least about 5 percent, by weight, and more preferably at least about 10 percent, and still more preferably at least about 20 percent, such as from about 5 to about 100 percent and more preferably from about 10 to about 80 percent, short cellulosic fiber having a pH of 5.0 or less. Further, it is generally preferred that the total fiber furnish have a WRV of about 1.40 g/g or less, such as from about 0.09 to about 1.40 g/g and more preferably from about 0.09 to about 1.20 g/g.

As illustrated in the table below, the foregoing fibrous structures have comparable or improved physical properties compared to a similarly manufactured fibrous structure substantially free from short acidic cellulosic fiber.

TABLE 1

| Furnish Composition (wt %) | GMT (g/3") | GM Slope (kg) | CD Stretch (%) | Sheet Bulk (cc/g) |
|---|---|---|---|---|
| 40% NSWK, 60% EHWK | 605 | 4.59 | 8.35 | 11.82 |
| 40% NSWK, 60% Low pH EHWK | 564 | 4.08 | 9.08 | 12.86 |

In certain embodiments the low pH fibers may be blended with one or more conventional papermaking fibers, such as hardwood or softwood kraft pulp fibers, and the blended pulp fibers may be selectively incorporated into one or more layers of a multi-layered tissue web. For example, it may be desirable to form layered tissue webs having three or more layers where the low pH fibers are selectively incorporated in one or more layers of the web. Thus, in one embodiment, the invention provides a multi-layered web having a middle layer disposed between first and second outer layers, where the low pH fibers are disposed in the first or second outer layer and the middle layer may consist essentially of refined long cellulosic fiber. In such embodiments the low pH fiber may be added to the first or second outer layers such that multi-layered web comprises greater than about 10 percent, by total weight of the multi-layered web, and more preferably greater than about 15 percent, and still more preferably greater than about 20 percent, such as from about to 20 to about 80 percent, low pH fiber.

In addition to varying the amount of acidic cellulosic fiber within the web, as well as the amount in any given layer, the physical properties of the web may be varied by the addition of certain wet or dry strength additives. The present inventors have observed that in certain instances replacing a portion of the conventional papermaking furnish with acidic cellulosic fibers may result in fibrous structures having a slightly less tensile strength. The decrease in tensile associated with the use of acidic cellulosic fibers may be overcome, in-part, by refining a portion of the fiber furnish. Refining however, may result in unwanted reduction in fiber length and an increase in water retention value. Thus, it may be desirable to use certain wet or dry strength additives to control tensile strength, rather than excessive refining, when manufacturing fibrous structures using acidic cellulosic fibers.

In forming fibrous structures of the present invention, strength resins can be added as dilute aqueous solutions at any point in the papermaking process where strength resins are customarily added. Such nonfibrous additions are described in Young, "Fiber Preparation and Approach Flow" Pulp and Paper Chemistry and Chemical Technology, Vol. 2, pp 881-882, which is incorporated by reference. In one embodiment, the fibrous structures of the present invention comprise from about 0.001 to about 3 percent strength resin, by weight of the fibrous structure, such as from about 0.1 to about 2 percent and more preferably from about 0.2 to about 1 percent. The strength additive resins are preferably selected from the group consisting of dry strength resins, permanent wet strength resins, temporary wet strength resins, and mixtures thereof.

Suitable wet strength agents include all chemistries capable of forming covalent bonds with cellulose fibers. Exemplary wet strength additives include, for example, permanent wet strength resins selected from the group consisting of polyamide-epichlorohydrin resins, glyoxalated polyacrylamide resins, styrene butadiene resins; insolubilized polyvinyl alcohol resins; urea-formaldehyde resins; polyethyleneimine resins; chitosan resins, and mixtures thereof. Particularly preferred wet strength resins are selected from the group consisting of polyamide-epichlorohydrin resins, glyoxalated polyacrylamide resins and mixtures thereof. One commercial source of a useful polyamide-epichlorohydrin resins is Solenis LLC, Wilmington, Del., which markets such resin under the trade-mark KYMENE.

The amount of the wet strength agent can be about 1.0 kg or greater per metric ton of dry fiber, more specifically from about 1.0 to about 20 kg per metric ton of dry fiber, still more specifically from about 2.0 to about 10 kg per metric ton of dry fiber.

Suitable dry strength agents include, for example, modified and unmodified starch, carboxymethyl cellulose resins, gums, polyacylamides, and mixtures thereof. In certain preferred embodiments dry strength agents may include cationic dry strength resins such as semi-synthetic cationic polymers derived from natural polymers, in particular from polysaccharides, such as starch and modified starch. In other embodiments dry strength agents may include anionic dry resins selected from the group consisting of carboxymethyl celluloses, carboxymethyl guar gums, anionic starches, anionic guar gums, anionic polyacrylamides, and mixtures thereof. One commercial source of useful semi-synthetic cationic dry strength agents is Ingredion Incorporated, Bridgewater, N.J. which markets such agents under the trade-mark RediBOND.

The amount of dry strength agent can be about 2.0 kg or greater per metric ton of dry fiber, more specifically from about 2.0 to about 20 kg per metric ton of dry fiber, still more specifically from about 3.0 to about 10 kg per metric ton of dry fiber.

In a particularly preferred embodiment, the use of a strength resin when forming the fibrous structures of the present invention results in a structure, such as a tissue product, having enhanced tensile strength without a corresponding increase in stiffness. Preferably the tissue webs and products produced according to the present invention have a geometric mean tensile strength greater than about 500 g/3", such as from about 500 to about 3,000 g/3" and more preferably from about 700 to about 2,500 g/3", yet have a stiffness index less than about 10.0, more preferably less than about 9.0, and still more preferably less than about 8.0, such as from about 5.0 to about 8.0.

In still other embodiments, the present disclosure provides tissue webs having enhanced bulk, softness and durability. Improved durability, such as increased machine and cross-machine direction stretch (MD Stretch and CD Stretch), and improved softness may be measured as a reduction in the slope of the tensile-strain curve (measured as GM Slope) or the stiffness index. For example, in certain embodiments tissue webs and products prepared as described herein generally have a GM Slope less than about 10.0 kg, such as from about 4.0 to about 10.0 kg and more preferably from about 5.0 to about 8.0 kg. In other embodiments tissue webs and products may have a MD Durability Index greater than about 8.0, such as from about 8.0 to about 16.0 and more preferably from about 10.0 to about 16.0.

Webs prepared as described herein may be converted into either single- or multi-ply tissue products that have improved properties over the prior art. In one embodiment the present disclosure provides a rolled tissue product comprising a spirally wound tissue web comprising one or more plies, the web having a basis weight greater than about 10 gsm, such as from about 10 to about 70 gsm and more preferably from about 10 to about 60 gsm and still more preferably from about 20 to about 45 gsm and a sheet bulk greater than about 5 cc/g, such as from about 5 to about 20 cc/g and more preferably from about 10 to about 15 cc/g.

In certain embodiments tissue products prepared according to the present invention have slightly reduced pH relative to tissue products that are substantially free from low pH fiber. For example, a tissue product prepared as described herein and comprising from about 30 to about 60 percent, by weight of the product, low pH fiber, more particularly low pH hardwood kraft fiber, may have a pH that is about 3 to about 10 percent less than a comparable tissue product that is substantially free from low pH fiber. For example, tissue products prepared according to the present invention may have a pH from about 6.0 to about 6.5, such as from about 6.0 to about 6.4 and more preferably from about 6.0 to about 6.3, while a comparable tissue product that is substantially free from low pH fiber may have a pH greater than about 6.7, such as from about 6.7 to about 7.5.

If desired, various chemical compositions may be applied to the fibrous structures, or to one or more layers of the multi-layered tissue web prepared according to the present invention, to further enhance softness and/or reduce the generation of lint or slough. For example, in some embodiments a chemical debonder can also be applied to soften the web or product. Specifically, a chemical debonder can reduce the amount of hydrogen bonds within one or more layers of the web, which results in a softer product. Depending on the desired characteristics of the resulting tissue product, the debonder can be utilized in varying amounts.

Any material capable of enhancing the soft feel of a web by disrupting hydrogen bonding can generally be used as a debonder in the present invention. In particular, as stated above, it is typically desired that the debonder possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty and carboxylic acid derivatives, mono and polysaccharide derivatives, polyhydroxy hydrocarbons, etc. For instance, some suitable debonders are described in U.S. Pat. Nos. 5,716,498, 5,730,839, 6,211,139, 5,543,067, and WO/0021918, all of which are incorporated herein in a manner consistent with the present disclosure.

The fibrous structures of the present disclosure can generally be formed by any of a variety of papermaking processes known in the art. Preferably the tissue web is formed by through-air drying and can be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multiply tissue products, the separate plies can be made from the same process or from different processes as desired.

Generally tissue product manufacture begins with forming a suitable fiber furnish comprising short cellulosic fiber having a pH less than 5.0. For example, a first furnish of short cellulosic fibers having a pH less than about 5.0 and a second furnish of long cellulosic fibers are fed to separate low consistency hydrapulpers which disperse dry lap pulp and broke into individual fibers. Pulping typically occurs at a consistency from about 4 to about 5 percent. The pulpers may run in a batch format to supply long and short fiber to the tissue machine. Once a batch of fiber is completed, it is pumped to a dump chest and diluted to a consistency from about 3 to about 4 percent. In a particularly preferred embodiment the short fiber furnish is not refined and is transferred directly to a clean stock chest and diluted to a consistency of from about 2 to about 3 percent. The long fiber furnish, after being completely dispersed in the pulper, is pumped to a dump chest and diluted to a consistency from about 3 to about 4 percent. Thereafter the long fiber furnish is transferred to a refiner where it is preferably subjected to mechanical treatment, such as a low level of refining, to impart some sheet strength without significantly increasing water retention value.

After dilution in a dump chest the short fiber and the long fiber furnishes may be blended in the machine chest in a pre-determined ratio of long to short fiber furnish, such as about 60 percent short fiber and 40 percent long fiber. Machine broke may be metered into the machine chest as well. The proportion of broke is dictated by performance specifications and current broke storage levels.

Once the two fiber furnishes are blended, the stock is pumped from the machine chest to a low density cleaner which decreases the stock consistency to about 0.6 percent. At any convenient point after the two furnishes have been blended, such as between the machine chest and the low density cleaner, the strength agents can be added sequentially to improve the sheet integrity. The sequence of addition will often depend on the polymeric charge densities of each material. The blended stock is further diluted to about 0.1 percent at the fan pump prior to entering the headbox. Thereafter the blended stock may be dispersed from the headbox onto a forming fabric to form a tissue web using any one of several different manufacturing methods known in the art.

For example, in one embodiment, tissue webs may be creped through-air dried webs formed using processes known in the art. To form such webs, an endless traveling forming fabric, suitably supported and driven by rolls, receives the layered papermaking stock issuing from headbox. A vacuum box is disposed beneath the forming fabric and is adapted to remove water from the fiber furnish to assist in forming a web. From the forming fabric, a formed web is transferred to a second papermaking fabric, such as a woven endless belt comprising a plurality of deflection members, and subjected to further dewatering. Any convenient means conventionally known in the papermaking art can be used to further dewater the intermediate fibrous web. In one example of a dewatering process, the intermediate fibrous web in association with the deflection member passes through a flow-through dryer (hot air dryer) and exits having a consistency of from about 30 to about 80 percent.

The partially dried web, which may still be associated with a deflection member, may travel between an impression nip roll and a surface of a Yankee dryer where the ridge pattern formed by the top surface of the deflection member is impressed into the partially dried fibrous web to form a linear element imprinted fibrous web. The imprinted fibrous web can then be adhered to the surface of the Yankee dryer where it can be dried to a consistency of at least about 95 percent. The web is then removed from the Yankee dryer by a creping blade. The creping web as it is formed further reduces internal bonding within the web and increases softness.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition or a conventional creping adhesive. The web is adhered to the surface of the dryer drum and then creped from the drum using the creping blade. If desired, the dryer drum may be associated with a hood. The hood may be used to force air against or through the web.

In certain embodiments forming a fibrous structure from a furnish comprising short cellulosic fibers having a pH less than about 5.0 and a WRV less than about 1.10 g/g may increase the consistency of the nescient web immediately prior to the web being pressed onto the Yankee dryer. For example, the consistency of the wet sheet after the pressure roll nip (post-pressure roll consistency or PPRC) may be approximately 40 percent, and more preferably greater than about 40 percent and still more preferably greater than about 42 percent, such as from about 40 to 45 percent. In this manner the use of low pH fibers may increase the consistency of the web immediately prior to the Yankee dryer at least about 0.5 percent and more preferably about 0.75 percent and still more preferably at least about 1.0 percent, such as from about 0.5 to about 3.0 percent, compared to web comprising conventional papermaking fibers.

Once creped from the second dryer drum, the web may, optionally, be fed around a cooling reel drum and cooled prior to being wound on a reel. In other embodiments, once creped from the dryer drum, the web may be adhered to a second dryer drum. The second dryer drum may comprise, for instance, a heated drum surrounded by a hood. The drum may be heated from about 25 to about 200° C., such as from about 100 to about 150° C.

Further, in certain instances, once creped the tissue web may be pulled through a drying station. The drying station can include any form of a heating unit, such as an oven energized by infra-red heat, microwave energy, hot air, or the like. A drying station may be necessary in some applications to dewater and dry the web and/or cure the creping composition. Depending upon the creping composition selected, however, in other applications a drying station may not be needed.

In other embodiments, the base web is formed by an uncreped through-air drying process such as those described, for example, in U.S. Pat. Nos. 5,656,132 and 6,017,417, both of which are hereby incorporated by reference herein in a manner consistent with the present disclosure. The uncreped through-air drying process may comprise a twin wire former having a papermaking headbox which injects or deposits a furnish of an aqueous suspension of wood fibers onto a plurality of forming fabrics, such as an outer forming fabric and an inner forming fabric, thereby forming a wet tissue web. The forming process may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of at least about 20 percent, more specifically between about 20 to about 40 percent, and more specifically about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.). The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross (CD) or machine direction (MD) (expressed as percent elongation at sample failure). This is commonly referred to as "rush transfer," and may result in the macroscopic rearrangement of fibers thereby forcing the sheet to bend and fold into the depressions on the surface of the transfer fabric. Such molding to the contours of the surface of the transfer fabric may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure. The wet tissue web is then transferred from the transfer fabric to a through-air drying fabric.

In certain embodiments forming a fibrous structure from a furnish comprising short cellulosic fibers having a pH less than about 5.0 and a WRV less than about 1.10 g/g may increase the consistency of the nescient web immediately prior to through-air drying. For example, the consistency of the partially dewatered web may be about 30 percent or greater when it is transferred to the though-air drying fabric, and more preferably greater than about 31 percent and still more preferably greater than about 32 percent, such as from about 30 to 34 percent. In this manner the use of low pH fibers may increase the consistency of the web prior to through-air drying at least about 0.5 percent and more preferably about 0.75 percent and still more preferably at least about 1.0 percent, such as from about 0.5 to about 3.0 percent, compared to web comprising conventional papermaking fibers.

While supported by the through-air drying fabric, the wet tissue web is dried to a final consistency of about 94 percent or greater by a through-air dryer. The drying process can be any noncompressive drying method which tends to preserve the bulk or thickness of the wet web including, without limitation, through-air drying, infra-red radiation, microwave drying, etc. Because of its commercial availability and practicality, through-air drying is well known and is one commonly used means for noncompressively drying the web for purposes of this invention. Suitable through-air drying fabrics include, without limitation, fabrics with substantially continuous machine direction ridges whereby the ridges are made up of multiple warp strands grouped together, such as those disclosed in U.S. Pat. No. 6,998,024. Other suitable through-air drying fabrics include those disclosed in U.S. Pat. No. 7,611,607, which is incorporated herein in a manner consistent with the present disclosure, particularly the fabrics denoted as Fred (t1207-77), Jetson (t1207-6) and Jack (t1207-12). The web is preferably dried to final dryness on the through-air drying fabric, without being pressed against the surface of a Yankee dryer, and without subsequent creping.

Additionally, webs prepared according to the present disclosure may be subjected to any suitable post processing including, but not limited to, printing, embossing, calendering, slitting, folding, combining with other fibrous structures, and the like.

Test Method

Fiber pH

Fiber pH was measured according to ISO 6588 "Paper, board and pulps—Determination of pH of aqueous extracts." The fiber sample amount was 2 grams (oven dried) and the pH of the sample was determined using the cold extraction method detailed in ISO 6588. Prior to measurement of the fiber pH the pH meter was calibrated by using at least two different buffer solutions.

Tissue pH

The pH of tissue samples was measured according to ISO 6588 "Paper, board and pulps—Determination of pH of aqueous extracts." The fiber sample amount was 2 grams (oven dried) and the pH of the sample was determined using the cold extraction method detailed in ISO 6588. Prior to measuring the pH of a tissue sample the pH meter was calibrated by using at least two different buffer solutions. The pH of the tissue was the average of two sample measurements and each sample weighed 2 grams (oven dried). The pH of the samples was determined using the cold extraction method detailed in ISO 6588.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting either a 3 inch±0.05 inch (76.2 mm±1.3 mm) or 1 inch±0.05 inch, wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Slope is also calculated by the tensile tester and recorded in units of kg.

Water Retention Value

The water retention value (WRV) of a pulp specimen is a measure of the water retained by the wet pulp specimen after centrifuging under standard conditions. WRV can be a useful tool in evaluating the performance of pulps relative to dewatering behavior on a tissue machine. One suitable method for determining the WRV of a pulp is TAPPI Useful Method 256, which provides standard values of centrifugal force, time of centrifuging, and sample preparation. Various commercial test labs are available to perform WRV testing using the TAPPI test or a modified form thereof.

Hemicellulose Content

The hemicellulose content of cellulosic fiber is measured by the 18 percent caustic solubility method (TAPPI T-235 CM-00). In this method, a weighed quantity of pulp (1.5 g) is soaked in 18 percent by weight aqueous sodium hydroxide (100 mL) for 1 hour. During the soak, the pulp fibers swell and the pulp's hemicellulose dissolves into solution. The pulp is then filtered, and 10 mL of the filtrate is mixed with 10 mL of potassium dichromate and 30 mL sulfuric acid. This solution is titrated with ferrous ammonium sulfate. The percent alkali solubility is then calculated using the amounts of the various solutions and the amount of pulp.

Handsheet Formation

Preparation of wet-laid handsheets was carried out using a Valley Handsheet mold, 8×8 inches. Handsheets were approximately 7.5×7.5 inches and had a basis weight of about 60 grams per square meter. The sheet mold forming wire is a 90×90 mesh, stainless-steel wire cloth, with a wire diameter of 0.0055 inch. The backing wire is a 14×14 mesh with a wire diameter of 0.021 inch, plain weave bronze. Taking a sufficient quantity of the thoroughly mixed stock to produce a handsheet of about 60 grams per square meter, the stock container of the sheet mold was clamped in position on the wire. Several inches of water was allowed to rise above the wire. The measured stock was added and the mold was filled with water up to a mark of 6 inches above the wire. The perforated mixing plate was inserted into the mixture in the mold and slowly moved down and up 7 times. The water leg drain valve was immediately opened. When the water and stock mixture drained down to and disappeared from the wire, the drain valve was closed. The cover of the sheet mold was raised. A clean, dry blotter was carefully placed on the formed fibers. The dry couch roll was placed at the front edge of the blotter. The fibers adhering to the blotter were couched off the wire by one passage of the couching roll, without pressure, from front to back of wire.

The blotter with the fiber mat adhering to it was placed in the hydraulic press, handsheet up, on top of two used, re-dried blotters. Two new blotters were placed on top of the handsheet. The press was closed and clamped. Pressure was applied to give a gauge reading that produced 75 PSI on the area of the blotter affected by the press. This pressure was maintained for exactly one minute. The pressure on the press was then released. The press was opened and the handsheet was removed.

The handsheet was placed on the polished surface of the sheet dryer (Valley Steam hot plate). The canvas cover was carefully lowered over the sheet. The 13 lb. dead weight was fastened to the lead filled brass tube. The sheet was allowed to dewater and dry for 2 minutes. The surface temperature, with the cover removed, averaged about 100° C.

EXAMPLES

Commodity pulps, having the properties set forth in Table 2, below, were obtained and used to evaluate the effect of pulp pH on handsheet and tissue product properties.

TABLE 2

| | Northern Softwood Kraft Pulp (NSWK) | *Eucalyptus* Hardwood Kraft Pulp (EHWK) | Low pH *Eucalyptus* Hardwood Kraft Pulp (Low pH EHWK) |
|---|---|---|---|
| Average Fiber Length (mm) | 2.42 | 0.73 | 0.71 |

TABLE 2-continued

| | Northern Softwood Kraft Pulp (NSWK) | *Eucalyptus* Hardwood Kraft Pulp (EHWK) | Low pH *Eucalyptus* Hardwood Kraft Pulp (Low pH EHWK) |
|---|---|---|---|
| pH | 6.54 | 6.30 | 4.37 |
| WRV (g/g) | 1.38 | 1.29 | 1.00 |
| Hemicellulose (wt %) | — | 7.1 | 9.12 |

Example 1: Handsheets

The effect of pH, refining and strength agent on fibrous structure tensile strength was evaluated by manufacturing handsheets, as described above. In certain instances handsheet tensile strength was modified by refining the NSWK portion of the furnish. In other instances handsheet tensile strength was modified by adding starch (RediBOND 2038A, Ingredion Incorporated, Bridgewater, N.J.). The composition of each of the handsheet codes is set forth in Table 3, below.

TABLE 3

| Code | NSWK (wt %) | EHWK (wt %) | Low pH EHWK (wt %) | NSWK PFI Refining (Revs.) | Starch (kg/MT) | Total Furnish Freeness (mL) | Furnish WRV (g) |
|---|---|---|---|---|---|---|---|
| 1 | 40 | 60 | — | 0 | 0 | 584 | 1.151 |
| 2 | 40 | — | 60 | 0 | 0 | 615 | 1.051 |
| 3 | 40 | — | 60 | 100 | 0 | 616 | 1.146 |
| 4 | 40 | — | 60 | 200 | 0 | 616 | 1.179 |
| 5 | 40 | — | 60 | 500 | 0 | 599 | 1.329 |
| 6 | 40 | — | 60 | 1000 | 0 | 592 | 1.379 |
| 7 | 40 | — | 60 | 0 | 2 | 655 | 1.094 |
| 8 | 40 | — | 60 | 0 | 4 | 663 | 1.094 |
| 9 | 40 | — | 60 | 0 | 6 | 664 | 1.134 |

The handsheet tensile strengths are summarized in Table 4, below and illustrated in FIG. 1.

TABLE 4

| Code | Tensile Strength (g/1") |
|---|---|
| 1 | 2871 |
| 2 | 2675 |
| 3 | 2770 |
| 4 | 3028 |
| 5 | 3826 |
| 6 | 4398 |
| 7 | 2931 |
| 8 | 3244 |
| 9 | 3406 |

Example 2: Through Air Dried Tissue Products

A single ply through-air dried tissue web was made generally in accordance with U.S. Pat. No. 5,607,551, which is herein incorporated by reference in a manner consistent with the present disclosure. More specifically, about 1000 pounds (oven dry basis) of NSWK was dispersed in a pulper at 100° F. for 30 minutes at a consistency of about 3.5 percent before being transferred to a machine chest and diluted to a consistency of 2 percent. In certain instances the NSWK was refined prior to formation of the tissue web, as set forth in Table 5, below. In-loop refining was carried out with the refiner plates turned by a motor producing 19.5 KW (no-load rating of 19 KW), but backed-out all the way.

About 1000 pounds (oven dry basis) of EHWK was dispersed in a pulper at 100° F. for 30 minutes ata consistency of about 3.5 percent before being transferred to a second machine chest and diluted to a consistency of 2 percent. The EHWK pulp was not refined or otherwise subjected to mechanical forces prior to formation of the tissue web.

About 1000 pounds (oven dry basis) of Low pH EHWK pulp was dispersed in a pulper at 100° F. for 30 minutes at a consistency of about 35 percent before being transferred to a third machine chest and diluted to 2 percent consistency. The Low pH EHWK pulp was not refined or otherwise subjected to mechanical forces prior to formation of the tissue web.

To produce a layered tissue web each stock was further diluted to approximately 0.1 percent consistency and transferred to a 3-layer headbox and dispersed onto a forming fabric. The fiber compositions of the layered sheets are described in Table 5 below. The formed web was non-compressively dewatered and rush transferred to a transfer fabric traveling at a speed of about 28 percent slower than the forming fabric. The web was then transferred to a through-air drying fabric and dried.

The base sheet webs were converted into various bath tissue rolls. Specifically, base sheet was calendered using a conventional polyurethane/steel calender comprising a 40 P&J polyurethane roll on the air contacting side of the sheet and a standard steel roll on the fabric contacting side. All rolled products comprised a single ply of base sheet. The physical properties of the products are summarized in the tables below.

TABLE 5

| Sample | Center Layer (wt %) | Air Contacting Layer (wt %) | Fabric Contacting Layer (wt %) | Refining | Starch (kg/MT) | Calender Load (pli) |
|---|---|---|---|---|---|---|
| 1A | 40 NSWK | 30 EHWK | 30 EHWK | None | 0 | 40 |
| 2A | 40 NSWK | 30 EHWK | 30 EHWK | None | 2.5 | 40 |

TABLE 5-continued

| Sample | Center Layer (wt %) | Air Contacting Layer (wt %) | Fabric Contacting Layer (wt %) | Refining | Starch (kg/MT) | Calender Load (pli) |
|---|---|---|---|---|---|---|
| 3A | 40 NSWK | 30 EHWK | 30 EHWK | In-loop | 0 | 40 |
| 4A | 40 NSWK | 30 Low pH EHWK | 30 Low pH EHWK | None | 0 | 40 |
| 5A | 40 NSWK | 30 Low pH EHWK | 30 Low pH EHWK | None | 2.5 | 40 |
| 6A | 40 NSWK | 30 Low pH EHWK | 30 Low pH EHWK | In-Loop | 0 | 40 |

TABLE 6

| Sample | Basis Wt. (gsm) | Caliper (μm) | Sheet Bulk (cc/g) |
|---|---|---|---|
| 1A | 39.767 | 505 | 11.82 |
| 2A | 39.812 | 537 | 12.53 |
| 3A | 40.333 | 612 | 14.13 |
| 4A | 40.158 | 554 | 12.86 |
| 5A | 39.521 | 513 | 12.06 |
| 6A | 40.100 | 575 | 13.34 |

TABLE 7

| Sample | MD Tensile (g/3) | MD Stretch (%) | GMT (g/3") | GM Slope (kg) | Stiffness Index | MD Tensile Index |
|---|---|---|---|---|---|---|
| 1A | 873 | 17.48 | 605 | 4.59 | 7.60 | 21.96 |
| 2A | 1081 | 18.68 | 744 | 4.74 | 6.38 | 27.15 |
| 3A | 1141 | 18.56 | 763 | 4.73 | 6.20 | 28.29 |
| 4A | 817 | 16.87 | 564 | 4.08 | 7.24 | 20.35 |
| 5A | 998 | 18.11 | 678 | 4.49 | 6.62 | 25.26 |
| 6A | 1081 | 18.14 | 706 | 4.56 | 6.46 | 26.96 |

While the invention has been described in detail in the foregoing description and examples, those skilled in the art will appreciate that the present invention may be embodied in any one of several different embodiments including, for example:

In a first embodiment the present invention provides a method of manufacturing a fibrous structure comprising the steps of providing a first fibrous furnish comprising acidic cellulosic fibers having a pH less than about 5.0; providing a second fibrous furnish comprising cellulosic fibers having a pH greater than about 6.0; adding from about 1.0 to about 20 kilograms (kg) strength resin per metric ton (MT) of dry fibrous furnish to the first or the second fiber furnish; depositing the first and second fibrous furnishes on a forming fabric to form a wet fibrous web; partially dewatering the wet fibrous web; and drying the fibrous web to a consistency greater than about 95 percent.

In a second embodiment the present invention provides the method of the first embodiment wherein the wet fibrous web has a water retention value (WRV) from about 0.90 to about 1.40 g/g.

In a third embodiment the present invention provides the method of the first or the second embodiments wherein the second fibrous furnish comprises cellulosic fibers selected from the group consisting of softwood fibers, hardwood fibers, secondary fibers, and combinations thereof.

In a fourth embodiment the present invention provides the method of any one of the first through third embodiments wherein the second fibrous furnish comprises softwood fibers having a freeness from about 500 to about 700 mL.

In a fifth embodiment the present invention provides the method of any one of the first through fourth embodiments further comprising the step of refining the second fibrous furnish and wherein the refined second fibrous furnish has a freeness from about 500 to about 700 mL.

In a sixth embodiment the present invention provides the method of any one of the first through fifth embodiments wherein the acidic cellulosic fibers comprise hardwood fibers selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore and Beech.

In a seventh embodiment the present invention provides the method of any one of the first through sixth embodiments wherein the acidic cellulosic fibers have a water retention value (WRV) less than about 1.20 g/g.

In an eighth embodiment the present invention provides the method of any one of the first through seventh embodiments wherein the acidic cellulosic fibers have a water retention value (WRV) from about 0.90 to about 1.10 g/g.

In a ninth embodiment the present invention provides the method of any one of the first through eighth embodiments wherein the first fibrous furnish consists essentially of hardwood kraft pulp fibers having a pH from about 3.0 to 5.0 and a water retention value (WRV) from about 0.90 to about 1.10 g/g.

We claim:

1. A method of manufacturing a fibrous structure comprising the steps of:

a. providing a first fibrous furnish comprising acidic cellulosic fibers having a pH less than 4.5;

b. providing a second fibrous furnish comprising cellulosic fibers having a pH greater than about 6.0;

c. adding from about 1.0 to about 2.5 kilograms (kg) strength resin per metric ton (MT) of dry fibrous furnish to the first or the second fiber furnish;

d. depositing the first and second fibrous furnishes on a forming fabric to form a wet fibrous web;

e. partially dewatering the wet fibrous web; and f. drying the fibrous web to a consistency greater than about 95 percent.

2. The method of claim 1 wherein the wet fibrous web has a Water Retention Value (WRV) from about 0.90 to about 1.40 g/g.

3. The method of claim 1 wherein the second fibrous furnish comprises cellulosic fibers selected from the group consisting of softwood fibers, hardwood fibers, secondary fibers and combinations thereof.

4. The method of claim 1 wherein the second fibrous furnish comprises softwood fibers having a freeness from about 500 to about 700 mL.

5. The method of claim 1 further comprising the step of refining the second fibrous furnish and wherein the refined second fibrous furnish has a freeness from about 500 to about 700 mL.

6. The method of claim 1 wherein the acidic cellulosic fibers comprise hardwood fibers selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore and Beech.

7. The method of claim 1 wherein the acidic cellulosic fibers have a Water Retention Value (WRV) less than about 1.20 g/g.

8. The method of claim 1 wherein the acidic cellulosic fibers have a Water Retention Value (WRV) from about 0.90 to about 1.10 g/g.

9. The method of claim 1 wherein the first fibrous furnish consists essentially of hardwood kraft pulp fibers having a pH from about 3.0 to 5.0 and a Water Retention Value (WRV) from about 0.90 to about 1.10 g/g.

10. The method of claim 1 wherein the first fibrous furnish is not subject to mechanical treatment and has a freeness from about 550 to about 750 mL.

11. The method of claim 1 wherein the strength resin is added to the second fibrous furnish.

12. The method of claim 1 wherein the wet fibrous web comprises from about 20 to about 80 percent, by dry weight of the wet fibrous web, acidic cellulosic fibers-having a pH less than 4.5 and from about 20 to about 80 percent, by dry weight of the wet fibrous web, cellulosic fibers having a pH greater than about 6.0.

13. The method of claim 1 wherein the strength resin is a modified starch or carboxymethyl cellulose resins and the amount of strength resin added to the first or the second fiber furnish is from about 1.0 to about 2.5 kg per metric ton of dry fiber.

14. The method of claim 1 wherein the strength resin is selected from the group consisting of polyamide-polyamine epichlorohydrin resins, glyoxalated polyacrylamide resins, carboxymethyl celluloses, starch, starch derivatives, and combinations thereof, and the amount of strength resin added to the first or the second fiber furnish is from about 1.0 to about 2.5 kg per metric ton of dry fiber.

* * * * *